United States Patent [19]

Spieldiener et al.

[11] Patent Number: 4,516,943

[45] Date of Patent: May 14, 1985

[54] AMUSEMENT RIDE RAFT

[76] Inventors: Robert Spieldiener, Im Winkel 13, FL-9496 Balzers, Liechtenstein; Reinhold Spieldiener, Aussichtsstrasse 23, CH-8704 Herrliberg; Alfons Saiko, Speerstrasse 26A, CH-8942 Oberrieden, all of Switzerland

[21] Appl. No.: 507,993

[22] Filed: Jun. 24, 1983

Related U.S. Application Data

[63] Continuation-in-part of Ser. No. 274,639, Jun. 17, 1981, abandoned.

[51] Int. Cl.[3] ..... B63B 35/58

[52] U.S. Cl. ..... 441/35; 114/123; 114/219; 114/346; 114/357; 114/363; 272/32

[58] Field of Search ..... 441/35, 39, 40, 65, 441/66, 67; 114/62, 63, 123, 197, 264, 267, 292, 343, 345, 346, 348, 357, 360, 362, 363, 364; D21/71, 130, 242, 247, 250; D12/316; 272/1 R, 32, 33 A

[56] References Cited

U.S. PATENT DOCUMENTS

| | | | |
|---|---|---|---|
| D. 58,115 | 6/1921 | Stock | D21/250 |
| D. 180,585 | 7/1957 | Disney | D21/249 |
| D. 247,320 | 2/1978 | Zick | D21/249 |
| 2,391,326 | 12/1945 | McKinley | 114/292 |
| 2,544,599 | 3/1951 | Keelen | 114/123 |
| 2,848,725 | 8/1958 | Sloulin | 114/219 |
| 2,909,144 | 10/1959 | Baldwin | 114/197 |
| 3,548,428 | 12/1970 | Eades | 114/357 |
| 3,827,387 | 8/1974 | Morgan | 114/346 |
| 4,161,796 | 7/1979 | Kustanecki | 114/357 |

FOREIGN PATENT DOCUMENTS

| | | | |
|---|---|---|---|
| 611804 | 6/1978 | U.S.S.R. | 114/219 |

*Primary Examiner*—Trygve M. Blix
*Assistant Examiner*—Stephen P. Avila
*Attorney, Agent, or Firm*—Bruce & McCoy

[57] ABSTRACT

A raft for a rapid flow water course amusement ride having a generally circular shaped hull fabricated in two sections with a surrounding floatation bumper and separate redundant floatation material in the bottom of the hull. A multiplicity of inwardly facing high-backed seats are disposed around the inner periphery of the hull with a circular hand-hold in the center. The circular construction and seat distribution and arrangement, coupled with the redundant floatation feature, provides a stable and safe floatation device which is especially adapted to endure abuse from collisions with the water course banks and obstructions disposed in the water course while carrying a plurality of raft riders.

2 Claims, 5 Drawing Figures

AMUSEMENT RIDE RAFT

This application is a continuation-in-part of copending application Ser. No. 274,639, filed June 17, 1981 now abandoned.

BACKGROUND OF THE INVENTION

1. Field of the Invention

The present invention relates to amusement rid vehicles. More particularly it relates to a free floating circular raft which carries passengers on an amusement ride which has a rapid flow water course.

2. Description of the Prior Art

There are many types of boats and rafts which are utilized for traversing fast water rivers including jet drive power boats. Generally, the unpowered boats are inflated rubber rafts, canoes, and spacial row boats. In devising the first amusement ride which simulates a trip down a fast water river, it was of course necessary to provide a boat or raft which could carry the customer/-passengers. However, there were several problems not normally experienced by persons riding through a natural set of rapids in a fast water river. In an amusement ride, the passengers must be protected against injury, and they do not expect to get their shoes and clothes wet. In addition, in order to keep the expense of operating the rid reasonable, it was necessary to provide a boat which did not require an experienced driver guiding it down the water course. It was also desirable to have the boat free floating whereby it could drift with the water current for a realistic ride and yet deliver the passengers to the other end of the amusement ride uninjured, dry, and in a sitting position from which they could easily rise to exit the vehicle. For these reasons power boats, canoes, and row boats could not be used: all required an experienced driver or operator and a power boat would be much too expensive and a canoe too unstable or tippy. In addition, a row boat or canoe might be too long for a varying width water course (varying the width of the water course alters the water flow rate). If the row boat or canoe were too long, it could be hung up crosswise in the water course.

An inflated rubber raft, such as are commonly used to ride fast flowing rivers, would seem to be an obvious choice, but these have many significant disadvantages whereby they cannot be used for an amusement ride. The most obvious disadvantage is that all these rafts have a simple rubberized canvas floorboard which is unsteady and not very strong (a person can step right through it if he or she is not careful). These rafts do not have seats, the riders sit on the tubular sides and cross-braces of the boat whereby the riders can and do often fall overboard. These rafts are oblong and longer than they are wide so they could possibly get hung up crosswise in the water course the same as a row boat or canoe.

It was therefore a problem to provide an amusement ride raft which would solve the numerous disadvantages in these prior art boats. It was necessary to provide a boat which did not require an operator to keep it headed correctly in the water course. It was also desirable to have the boat traverse the water course without being guided by underwater rails or tracks; it was desirable that the boat be free floating. The boat had to have rigid floor board which would permit the passengers to stand directly on the bottom of the boat. It had to support all types of passengers: women wearing sharp heels, heavy persons, and it had to provide a stable platform for older persons. In addition, the boat had to have some means for a hand hold in order for people to keep their balance for safety.

It was also determined that the boat for the amusement ride should protect persons from falling overboard during the ride and should provide a normal seat which would permit a person to assume a normal sitting position rather than crouching down or sitting directly on the floor boards of a boat. It was desirable to provide protection from water spray. It was also determined that it was important to provide multiple entrances and exits to the boat so that several persons could enter and exit the boat at the same time or from multiple directions to accommodate any orientation of the boat with respect to the dock when changing riders. This would provide for rapid turn over of riders and better utilization of the boat. Only an enclosed motor boat provides these features; there is no known prior art boat which is a free floating raft which has these features.

For a free floating boat, it was necessary to provide shock protection for the customer/passengers against the boat running into an object. The boat also had to be able to traverse the water course without becoming hung up. It was also an important consideration to create a boat which was lightweight, and yet strong, and would resist the wear and abrasion caused by the boat hitting obstructions and the sides of the water course. Almost none of these problems had been considered let alone solved by the prior art, and there is no boat known from the prior art which provides a solution to all of the problems that need to be considered in providing a passenger boat for a rapid flow water course amusement ride.

SUMMARY OF THE INVENTION

The present invention is a raft for carrying riders on a rapid flow water course amusement ride. The water course has banks and objects disposed in the water course serving as intended obstruction to a straight line course of the raft. The raft has a generally circular shaped unitary hull which forms the raft's circular bottom and perimeter sides. A multiplicity of inwardly facing high backed seats are distributed substantially evenly around the inner periphery of the hull. A circular hand-hold is disposed in the center of the raft and can be grasped for balance by all of the raft riders seated in the inwardly facing seats. A cushion surrounds the outer periphery of the hull substantially in the plane of the hull bottom. It serves as a bumper to absorb the shock of collisions with the water course banks and objects in the water course. A redundant safety floatation material is disposed substantially throughout the bottom of the hull to provide additional buoyancy to the raft.

OBJECTS OF THE INVENTION

It is therefore an important object of the present invention to provide a raft for safely carrying passengers in a rapid flow water course amusement ride.

It is another object of the present invention to provide a raft for a rapid flow water course amusement ride which permits the riders to assume a normal sitting position with support against whiplash, with hand holds for balance, and with protection from water spray coming from outside the raft.

It is a further object of the present invention to provide a raft for a rapid flow water course amusement ride which requires no operator or driver and is free floating for traversing the water course without a guide track other than the banks of the water course.

And is still another object of the present invention to provide a raft for an amusement ride which is relatively inexpensive to construct, has a rigid floorboard, and provides multiple entrances and exits to the passenger area.

Other objects of the invention will become apparent when the preferred embodiment thereof is considered in detail in conjunction with the appended drawings.

DESCRIPTION OF THE PREFERRED EMBODIMENT

Figure 1:
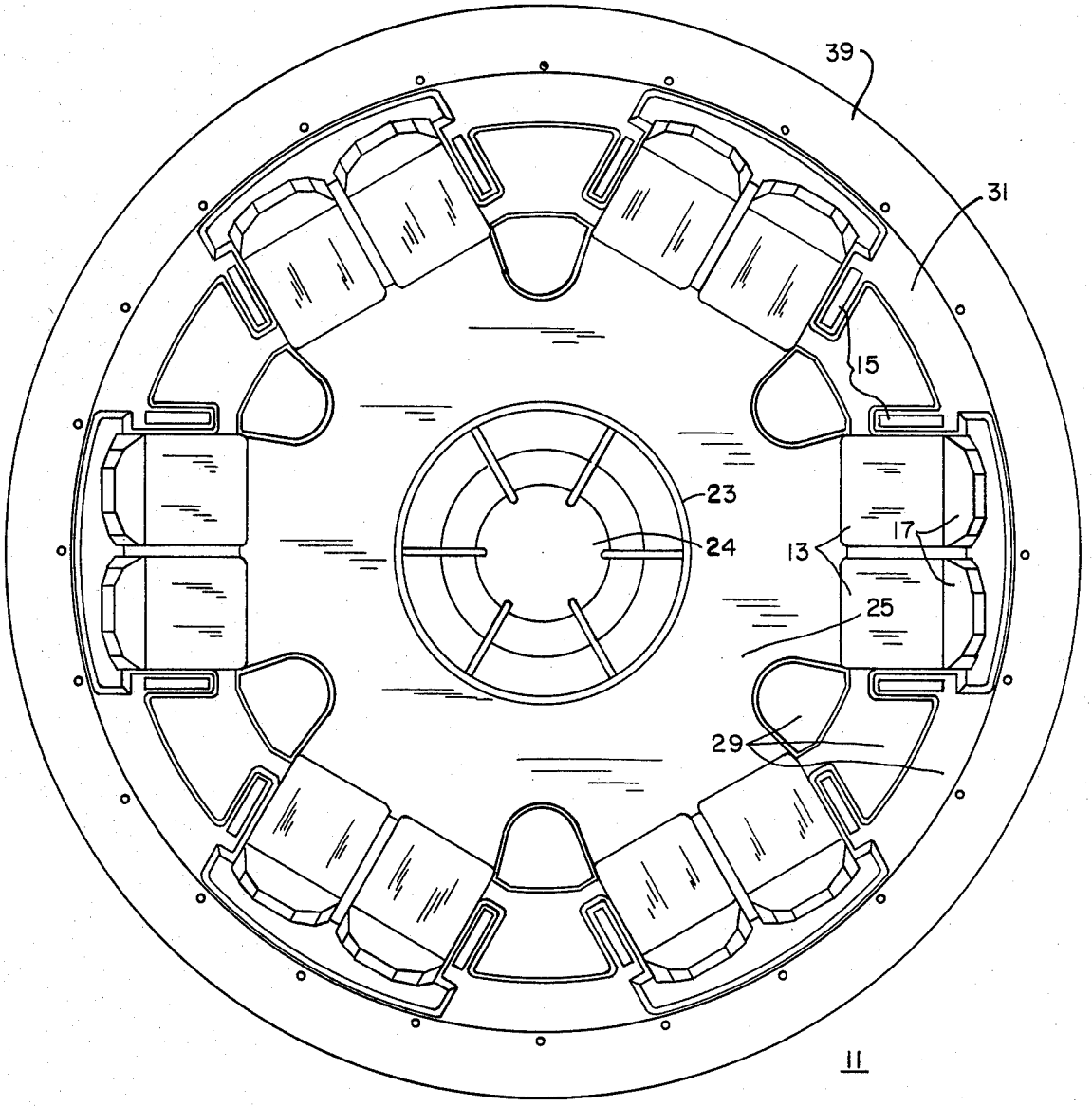
FIG. 1 is a top plan view of the amusement ride raft of the present invention.
Figure 2:
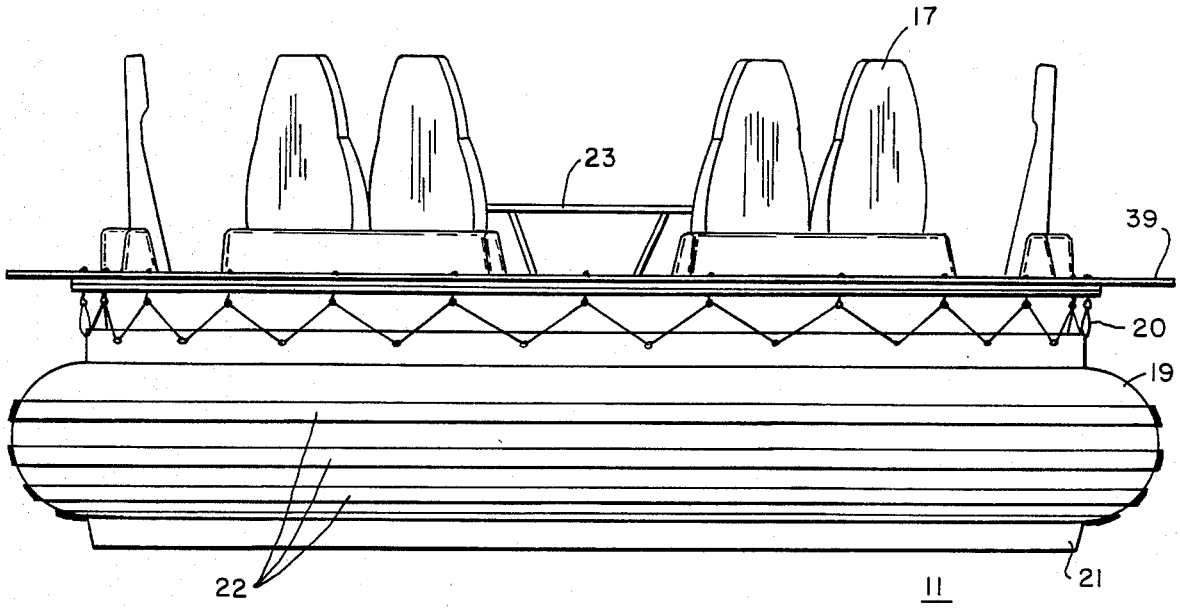
FIG. 2 is a side elevation of the present invention.
Figure 3:
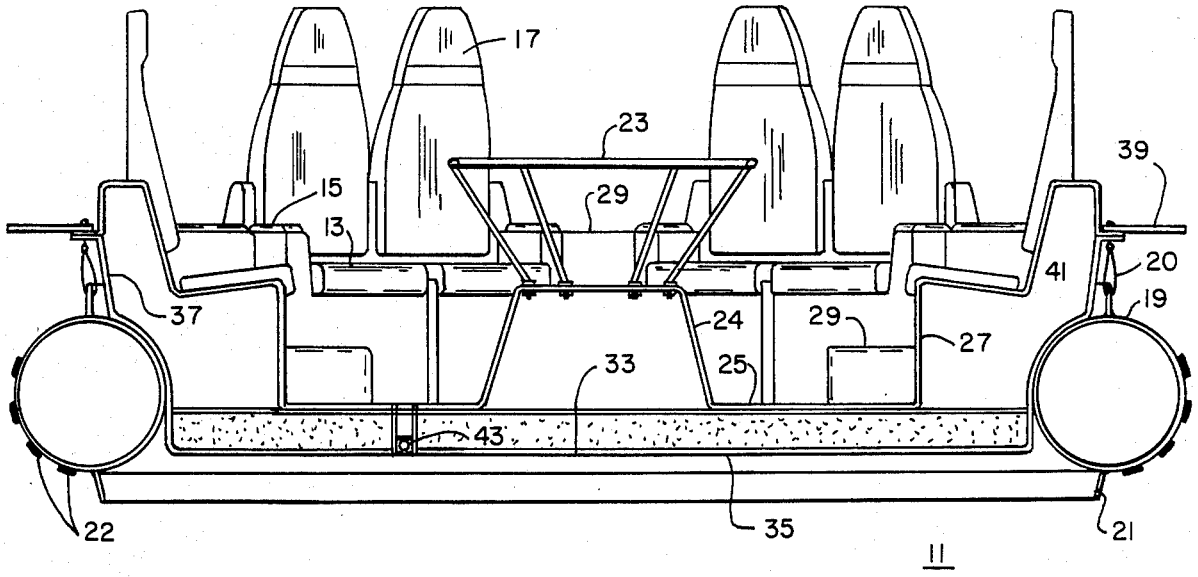
FIG. 3 is a section view of the present invention taken along lines 3—3 of FIG. 1.

The present invention is a passenger vehicle or raft for a rapid flow water course amusement ride. It is a round floating raft 11 having a generally circular shaped hull 12 and a multiplicity of inward facing seats 13 disposed around the inner periphery of the hull. The seats are provided with arm rests 15 and high backs 17 for supporting the head, neck, and back of the passenger against whiplash. The seats are disposed inwardly facing so that the backs of the passengers are supported and so that they are partially shielded from water spray and splash coming from outside of the raft. The seats permit the passengers to assume a normal sitting position rather than to crouch or sit awkwardly on the floor of the raft. This permits older persons to enjoy the amusement ride because they can easily sit down for the ride and then rise back to their feet at the end of the ride for exiting the boat. No other known rafts have heretofore been provided with proper seats for protecting the passenger against injury and water splash.

The circular shape distributes the weight around the periphery of the raft and permits it to free float in the water course without an operator. The circular configuration allows the raft to bump against the sides or banks of the water course, and roll along the side, or to strike an object in the water course and roll off it without becoming hung up.

The raft 11 is provided with a cushion means 19 surrounding the outer circular periphery of the hull. This is to absorb the shock of the raft striking the banks of the water course or objects in the water course. The cushion means can be formed from a series of individual pneumatic bumpers, such as sealed air bags, mounted around the outer periphery of the raft. It can also be formed from solid cushion material such as a dense foam rubber or synthetic plastic which has a skin resistant to abrasion and wear caused when the raft rubs along the banks of the water course.

Figure 4:
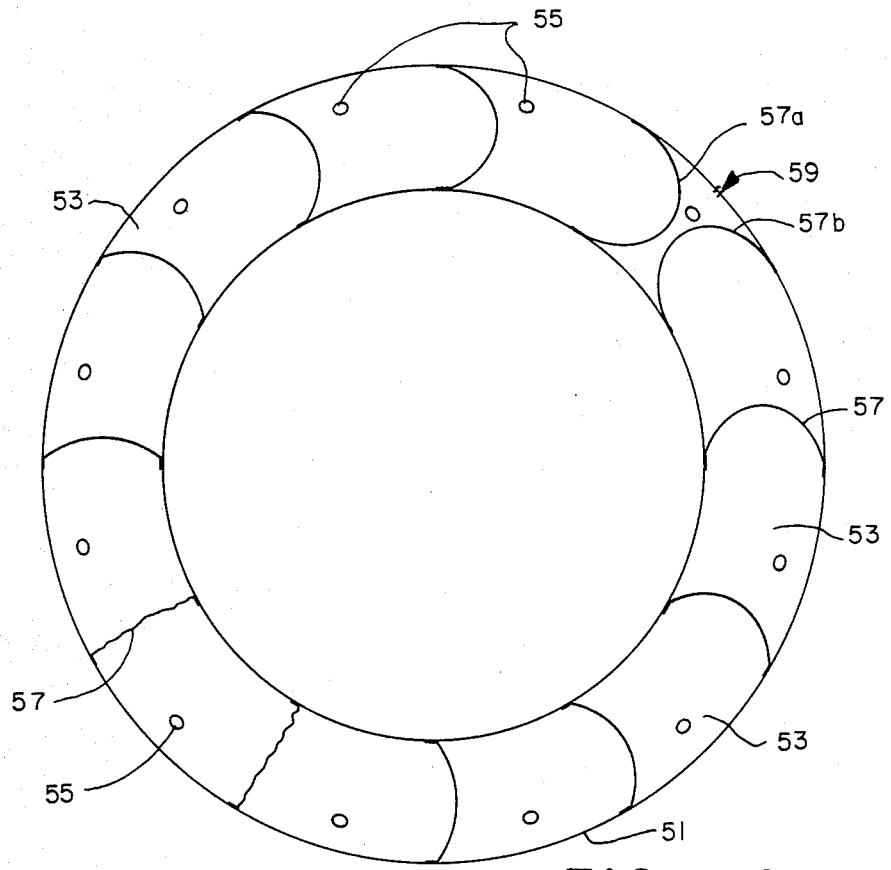
FIG. 4 is a bottom plan view in section of the inflatable circular bumper of the invention illustrating the air chamber construction and the function of the telescoping end walls in the presence of a puncture of one air chamber.

The the preferred embodiment, the bumper is formed from a circular inflatable bumper placed around the periphery of the fiberglass hull. The construction of this inflatable bumper as shown in FIG. 4 is of tubular rubber construction and has a number of separate chambers 53 each with an individual inflation valve 55. The internal separation walls 57 for the chambers are extensible collapsed bags so that they may expand in either direction if pressure is lost in an adjacent chamber. If one chamber is punctured and loses air, such as through puncture 59 shown in FIG. 4, the two adjacent separation walls 57*a*, 57*b*, will expand partway into the collapsing chamber to provide buoyancy to that chamber. The loss of air and buoyance of a punctured chamber in the preferred embodiment is only 15% or 20% of its volume.

Figure 5:
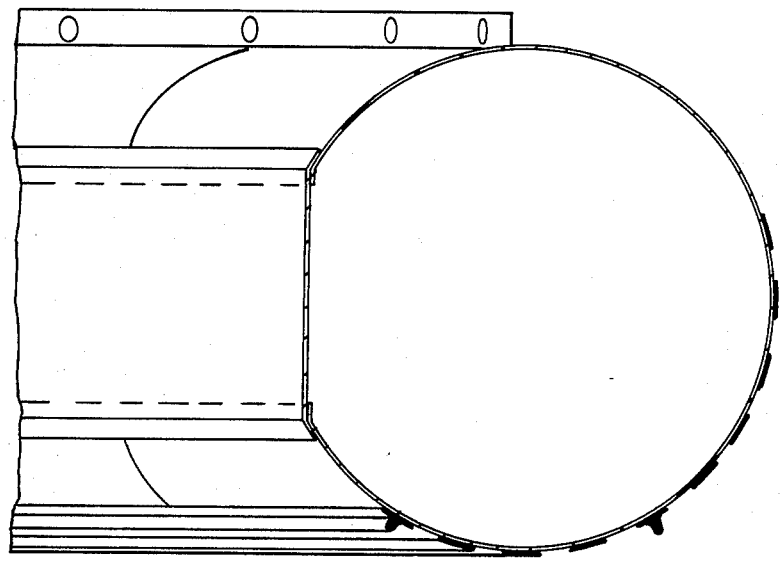
FIG. 5 is a cross section of the bumper cushion of the present invention showing the flat internal peripheral wall thereof where it engages the hull of the raft.

The circular inflatable bumper 51 is held in place by ropes 20 attached to the periphery of the hull of the raft. The bumper has a flange 52 vuncanized into the structural part of the rubber and equipped with holes and grommets to which the ropes are fastened. On the bottom, the bumper has a flexible circular fin 21 protruding downwards to provide additional freeboard contact with the flowing water in order to increase the effect of the current flow on the raft. The outer peripheral circumference of the bumper, where it contacts the walls or obstructions in the channel, is provided with wear strips 22 bonded to the surface of the bumper. These strengthen the bumper and provide additional protection against puncture. After they become worn from use, they can be replaced. The internal peripheral wall of the bumper is formed as shown in FIG. 5 with a flat vertical surface where it engages the hull which increases the engaging force between the hull and the bumper.

A circular hand hold 23 is disposed in the center of the raft 11 which can be grasped for balance by all of the raft riders. This hand hold is mounted on a central pedestal 24 formed integral to the raft floor boards 25.

The hull 12 is made from two mating hull sections with the inner upper section 27 forming the seat platform, entry steps 29, peripheral deck 31, floor boards 25, and the pedestal mount 24 for the hand hold 23. The lower outer hull section 33 forms the outside surface of the bottom 35 and the sides 37 of the raft. Steps 29 are formed integrally into the inner upper section between at least some of the seats at several locations around the internal periphery of the raft. These steps permit entrance and exiting to and from the internal passenger carrying portion of the raft by the passengers or riders.

In the preferred form, the seats 13 are formed in pairs of inward facing seats in the upper inner hull section 27, and the entry steps 29 are formed between the pairs of seats. The spaces between the seats for the steps permit the passengers to look across the raft and out to see the view and to prevent seasickness.

The inner and outer sections which form the hull of the raft can be formed in fiberglass molds and require only two relatively simple molds to make the whole raft. A splash guard 39 formed of a flat rubber ring is mounted on top of the flanges joining the upper and lower hull sections. The upholstry for the seats is secured to the inner upper section, and the cushion means is secured to the outer peripheral walls of the lower outer hull section. The outer periphery of lower hull section of the raft is formed with a recess 41 to accommodate the tubular bumper.

The bottom of the lower hull section 33 is filled with a closed cell foam up to the level of the bottom of the upper hull or inner section 27. The top of this layer of foam is sealed with fiberglass to further prevent water from entering the inner hull. The foam provides additional or redundant safety floatation for buoyancy and is sufficient by itself to prevent the raft from sinking. If the outer bumper should become even totally deflated, the fiberglass hull with the layer of foam will keep the boat with a full load of passengers afloat.

The bottom of the lower hull is equipped with self-bailing valves 43 which permit any water that may have accumulated inside of the boat to drain while the boat is floating level. These are one way flapper valves which prevent water from entering but permit water to drain out.

The design of the raft provides benefits not obtainable from the prior art. The passengers are evenly spaced around the periphery of the boat for balance; the passengers are provided with seats which protect them from injury and water splash and permit them to easily assume their seats on entering the raft and to easily rise to exit the raft; the passengers are provided with a hand-hold for balance and a steady floor for safety; the raft is free floating to obtain the maximum effect from the rapids in the water course; the raft has redundant safety floatation; and the raft does not require an operator to guide the raft through the water course.

It will be seen that the objects of the invention are achieved by the preferred embodiment described herein. While the invention has been described in considerable detail, the scope and coverage of the invention are not be limited except as may be necessitated by the appended claims.

We claim:

1. A raft for carrying a plurality of raft riders on a rapid flow water course amusement ride having water course banks and objects disposed in said water course with which said raft is intended to collide and bounce off of, said raft comprising a generally circular shaped unitary raft hull formed by two mating inner and outer hull sections formed to provide a circular hull bottom and perimeter sides, a multiplicity of pairs of inwardly facing, high-back seats substantially evenly distributed around the inner periphery of said hull, an outer peripheral deck and a floor board area formed in said inner hull section, entrance and exit steps formed in the inner hull section between said pairs of seats, said steps extending from said peripheral deck to said floor boards, a cushion means surrounding the outer periphery of hull substantially in the plane of the bottom of said hull and extending radially of said hull periphery to act as a bumper which will absorb the shock of collisions with said water course banks and objects, said cushion means being so constructed as to provide floatation to said raft, a hand-hold mount formed in the center of the inner hull section of said raft for a circular hand-hold secured to said hand-hold mount which can be grasped for balance by all the raft riders seated in said inwardly facing high backed seats, and redundant safety floatation material disposed substantially throughout the bottom of said outer hull section between said inner and outer sections to provide buoyancy to said raft in addition to the buoyancy provided by said cushion means.

2. A raft for carrying a plurality of raft riders on a rapid flow water course amusement ride having water course banks and objects disposed in said water course with which said raft is intended to collide and bounce off of, said raft comprising a generally circular shape unitary raft hull formed by two mating inner and outer hull sections formed to provide a circular hull bottom and perimeter sides, a multiplicity of pairs of inwardly facing, high-back seats substantially evenly disposed around the inner periphery of said hull, an outer peripheral deck and a floor board area formed in said inner hull section, entrance and exit steps formed in the inner hull section between said pairs of seats, said steps extending from said peripheral deck to said floor boards, a hand-hold mount formed in the center of said inner hull section and a circular hand rail secured to said hand-hold mount, an inflated circular bumper surrounding the outer periphery of said hull substantially in the plane of the bottom of said hull and extending radially of said hull periphery to act as a bumper which will absorb the shock of collisions with said water course banks and objects, said inflated bumper having multiple chambers defined by telescoping end walls whereby if a chamber is punctured and loses air, the end walls of adjacent chambers will extend partially into the deflated chamber to provide buoyancy to it, said inflatable bumper being provided with a flat internal peripheral wall where it engages the lower hull section, redundant safety floatation foam material disposed between said hull sections, and self-bailing means in the bottom of said hull which permits water to drain from said hull.

* * * * *